US011430354B2

(12) United States Patent
Hyman

(10) Patent No.: US 11,430,354 B2
(45) **Date of Patent: *Aug. 30, 2022**

(54) PHOTOLUMINESCENT IDENTIFIER SYSTEM FOR FIREFIGHTING EQUIPMENT

(71) Applicant: F. D. Signworks, LLC, Loxahatchee, FL (US)

(72) Inventor: Matthew J. Hyman, Loxahatchee, FL (US)

(73) Assignee: F.D. SIGNWORKS, LLC, West Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/109,608

(22) Filed: Dec. 2, 2020

(65) Prior Publication Data

US 2021/0118340 A1 Apr. 22, 2021

Related U.S. Application Data

(63) Continuation-in-part of application No. 16/125,855, filed on Sep. 10, 2018, now abandoned, which is a (Continued)

(51) Int. Cl.
*G09F 13/20* (2006.01)
*G09F 3/10* (2006.01)
(Continued)

(52) U.S. Cl.
CPC ..... *G09F 13/20* (2013.01); *A42B 3/0453* (2013.01); *G09F 3/10* (2013.01);
(Continued)

(58) Field of Classification Search
CPC . G09F 13/20; G09F 3/10; G09F 13/16; G09F 19/22; G09F 2019/225
See application file for complete search history.

(56) References Cited

U.S. PATENT DOCUMENTS 1,492,577 A * 5/1924 Obermeyer ..... A42B 3/105 2/5
2,387,512 A 10/1945 Hilberg
(Continued)

FOREIGN PATENT DOCUMENTS

| | | |
|---|---|---|
| JP | H11241052 | 9/1999 |
| RU | 68505 | 11/2007 |
| WO | WO2004058498 | 7/2004 |

OTHER PUBLICATIONS

Anonymous, "High temperature resistant bonding, sealing and coating compounds", Masterbond, Retrieved from Internet Jan. 6, 2018, https://www.web.archive.org/web/20147030003726/https://www.masterbond.com/properties/high-temperature-resistant-bonding-sealing-and-coating-compounds, pp. 1-3, (2014).

*Primary Examiner* — Shin H Kim
(74) *Attorney, Agent, or Firm* — McHale & Slavin, P.A.

(57) ABSTRACT

The present system provides a lightweight fire-resistant photoluminescent identifier system for firefighters, which is suitable for use on the firefighter's facemask, as well as other equipment. The system is lightweight and provides individual recognition of an individual firefighter. The identifier system lights up automatically in a low-light environment without batteries, yet prevents glare to the firefighter using the system. The components that comprise the system are fire-resistant to temperatures up to and exceeding 500 degrees Fahrenheit to facilitate personal recognition of the individual in dark and low-light areas.

18 Claims, 18 Drawing Sheets

Related U.S. Application Data continuation of application No. 15/494,078, filed on Apr. 21, 2017, now Pat. No. 10,074,295.

(60) Provisional application No. 62/325,824, filed on Apr. 21, 2016.

(51) Int. Cl.

| | |
|---|---|
| ***A42B 1/24*** | (2021.01) |
| ***A42B 1/06*** | (2021.01) |
| ***A42B 3/04*** | (2006.01) |
| *G09F 3/02* | (2006.01) |
| *G09F 7/12* | (2006.01) |

(52) U.S. Cl.

CPC ..... *G09F 2003/023* (2013.01); *G09F 2003/0257* (2013.01); *G09F 2003/0272* (2013.01); *G09F 2007/127* (2013.01)

(56) References Cited

U.S. PATENT DOCUMENTS 3,452,464 A 7/1969 Robinson
4,401,050 A 8/1983 Britt et al.
4,671,003 A 6/1987 Vitol
4,945,458 A 7/1990 Batts et al.
4,975,980 A * 12/1990 Ersteniuk ..... A42B 3/105 2/172
5,000,111 A * 3/1991 Gibson ..... G01C 21/00 116/209
5,111,366 A 5/1992 Rife et al.
5,151,678 A 9/1992 Veltri et al.
5,300,783 A 4/1994 Spencer et al.
5,369,899 A * 12/1994 Reeves ..... A44C 3/001 24/303
5,415,911 A 5/1995 Zampa et al.
5,564,128 A 10/1996 Richardson
5,698,301 A 12/1997 Yonetani
5,740,557 A * 4/1998 Reid ..... A42B 1/248 2/195.1
5,904,017 A 5/1999 Glatz et al.
6,154,992 A * 12/2000 Lee ..... A42B 1/248 2/209.13
6,237,266 B1 5/2001 Tassey et al.
6,279,180 B1 8/2001 Bell et al.
6,305,028 B1 10/2001 Lin
6,458,464 B1 10/2002 Takeda
6,569,786 B1 5/2003 Marsh
6,696,126 B1 2/2004 Fischer et al.
6,701,649 B1 3/2004 Brosi
6,785,992 B2 9/2004 Chiarucci
7,166,369 B2 1/2007 Sturley
7,178,931 B1 2/2007 Murphy
7,201,415 B2 * 4/2007 Elwell ..... B60R 13/00 296/1.08
7,409,730 B2 * 8/2008 Boos ..... A41F 1/002 2/132
7,658,020 B1 * 2/2010 Yun ..... A43C 11/24 36/136
7,721,470 B2 * 5/2010 Long ..... A43B 3/24 36/136
7,735,152 B2 * 6/2010 Golle ..... A41D 13/01 2/102
7,832,131 B2 11/2010 Thollin
7,963,004 B2 * 6/2011 Cho ..... A44C 3/001 24/3.1
8,015,626 B2 * 9/2011 Grassi ..... A62B 18/084 2/422
8,037,840 B2 * 10/2011 Sutter ..... G09F 19/22 116/200
8,286,378 B2 * 10/2012 Martin ..... C09K 11/02 40/542
8,479,423 B2 * 7/2013 Martin ..... F21K 2/00 40/542
8,635,713 B2 * 1/2014 Smith ..... A42B 1/208 2/200.3
8,652,651 B2 2/2014 Sohn et al.
8,938,898 B2 * 1/2015 Lo ..... G09F 13/20 40/542
9,498,013 B2 * 11/2016 Handshaw ..... G01J 5/0018
9,775,391 B1 * 10/2017 Gonzalez ..... F21V 33/0076
10,074,295 B2 9/2018 Hyman
10,149,508 B2 * 12/2018 Gonzalez ..... A42B 3/0453
2002/0030139 A1 3/2002 Apel et al.
2002/0127361 A1 9/2002 Sandt et al.
2004/0182508 A1 9/2004 Apel et al.
2004/0202812 A1 10/2004 Congard et al.
2005/0102871 A1 5/2005 Merle et al.
2005/0142371 A1 6/2005 Swain et al.
2005/0244595 A1 11/2005 Hagen et al.
2006/0080873 A1 4/2006 Riopel et al.
2007/0251849 A1 11/2007 Lo et al.
2009/0229510 A1 * 9/2009 Sutter ..... G09F 19/22 116/209
2010/0018092 A1 1/2010 Peckham
2010/0299984 A1 * 12/2010 Khieu ..... G09F 13/16 40/612
2011/0119972 A1 5/2011 Kay
2012/0023793 A1 2/2012 Williams
2012/0233895 A1 9/2012 Martin et al.
2012/0318985 A1 * 12/2012 Bushee ..... A01K 27/006 250/342
2013/0143040 A1 6/2013 Green et al.
2014/0008441 A1 1/2014 Huynh
2014/0331530 A1 * 11/2014 Masanek, Jr. ..... B60R 13/105 40/209
2015/0178613 A1 6/2015 Hoelzl et al.
2016/0253931 A1 * 9/2016 Sakko ..... G09F 13/16 40/582
2017/0360256 A1 12/2017 Sheridan
2020/0357313 A1 11/2020 Hyman

* cited by examiner

PHOTOLUMINESCENT IDENTIFIER SYSTEM FOR FIREFIGHTING EQUIPMENT

RELATED APPLICATIONS

In accordance with 37 C. F. R 1.76, a claim of priority is included in an Application Data Sheet filed concurrently herewith. Accordingly, the present invention claims priority as a continuation-in-part of U.S. patent application Ser. No. 16/125,855, entitled "PHOTOLUMINESCENT IDENTIFIER SYSTEM FOR FIREFIGHTING EQUIPMENT", filed Sep. 10, 2018, which claims priority as a continuation of U.S. patent application Ser. No. 15/494,078, entitled "PHOTOLUMINESCENT IDENTIFIER SYSTEM FOR FIREFIGHTING EQUIPMENT", filed on Apr. 21, 2017, now U.S. Pat. No. 10,074,295, issued Sep. 11, 2018, which claims priority of U.S. Provisional Patent Application No. 62/325,824, entitled "PHOTOLUMINESCENT IDENTIFIER SYSTEM FOR FIREFIGHTING EQUIPMENT", filed on Apr. 21, 2016. The contents of the above referenced application are herein incorporated by reference in its entirety.

FIELD OF THE INVENTION

This invention relates generally to the field of safety for emergency fire personnel and, in particular, to a fire-resistant photoluminescent identifier system for a self-contained breathing apparatus (SCBA) utilized in firefighting equipment, which illuminates in low-light and/or low visibility areas to provide emergency markers for other emergency personnel.

BACKGROUND OF THE INVENTION

A self-contained breathing apparatus, or SCBA, is a device worn by firefighters and rescue personnel to provide breathable air in an immediate danger to life and health situation. A SCBA typically has three main components: a high-pressure tank, a pressure regulator, and an inhalation connection (face mask), all affixed together and mounted onto a carrying frame. SCBA's are one of the most important items of personal protective equipment used by firefighters and rescue personnel. SCBA's allow firefighters to enter hazardous environments to perform essential interior operations, including offensive fire attacks, victim search, rescue and removal, ventilation, and overhaul. They are also used at non-fire incidents involving hazardous materials and confined spaces where there is a threat of toxic fumes or an oxygen-deficient atmosphere.

SCBA systems used in firefighting place an emphasis on quality of materials required for heat and flame resistance above that of manufacturing cost. SCBA systems tend to be expensive because of the exotic materials used to provide heat and flame resistance and, to a lesser extent, to reduce the weight penalty on the firefighter. A major use of SCBA systems is for Search and Rescue (SAR) operations.

One of the most common causes of death of firefighters is the inability to find their way out of a burning building. Firefighters usually perform their work in smoke so thick that visibility is extremely limited. When entering a building, firefighters will typically choose a left-hand search pattern or right-hand search pattern, feeling their way along the walls. If a firefighter gets separated from his partner and becomes lost or disoriented, he/she may not be able to find a way out of the burning building.

Larger fires may have an appointed Rapid Intervention Team (RIT) or Rapid Intervention Crew (RIC). The RIT or RIC typically consists of two or three firefighters whose mission is to rescue downed firefighters, for example, firefighters who are injured or who are trapped or lost inside the fire. Time is of the essence for the RIT team. The team must locate the incapacitated or trapped firefighter before he runs out of air. Thus, a lightweight device or system that does not require electrical power, yet is fire resistant and provides a light to help locate the firefighter in a dark or smoky environment, is needed in the art.

Photoluminescent materials, also known as "glow-in-the-dark" materials, incorporate inorganic phosphors into a carrier or substrate. The substrate might be a solvent-based or water-based paint, a magnetic- or adhesive-backed tape, a plastic extrusion, an acrylic or polyurethane casting or injection molded item, or a vinyl film. These photoluminescent (PL) phosphors absorb light in the visible and ultraviolet wavelengths and release visible light in what is often termed an "afterglow". One of the advantages to photoluminescent technology is that there is no power source needed to properly function, as such it is self-sustaining. However, a shortcoming to photoluminescent technology is that, when used on the firefighter's facemask, the rearward glow through the lens reduces the firefighter's vision by creating reflections and shadows.

Safety lights mounted on various parts of an emergency personnel's body or equipment is known in the prior art. For instance, U.S. Pat. No. 4,945,458 provides fireman helmets with front and rear lights. The helmets include both a front light assembly and a rear light assembly; however, these devices require a power source attached thereto and do not provide individual recognition of the firefighter. U.S. Pat. No. 5,111,366 discloses a head covering having illuminated indicia formed thereon; however, this device requires an illuminated front panel which is edge-lit by a plurality of lamps or light emitting diodes powered by a battery source. It is not removably securable to any equipment, requires a power source, and is not fire-resistant. U.S. Pat. No. 5,151,678 discloses electroluminescent safety belts which provide for battery operation located within a portion of the belt. U.S. Pat. No. 5,564,128 describes a safety helmet which, when worn by a user, allows for locating and visual identification of the wearer in a hostile environment. Specifically, a safety helmet which provides for an electroluminescent strip member conformed and attached to a face shield or crown with actuating circuitry to provide blinking of the strip member when no motion is detected and emits different colors. The flexible electroluminescent strip member is fixedly secured to the safety helmet for emitting electromagnetic radiation within a visible bandwidth of the electromagnetic energy spectrum. A shortcoming of all of these devices is the requirement of batteries for operation. Batteries often fail at the most undesirable time. In addition, many batteries are an explosion hazard within the high heat environment of a firefighter. Still yet, batteries create an electrical field which may be undesirable around explosive materials. Even further, electroluminescent strips are not fire resistant and may cause damage to the lens of a facemask at temperatures above 200 degrees Fahrenheit, which is far too low of a temperature for most situations.

With the increased world-wide threat of terrorism, along with the already dangerous occupations in fire, military, law enforcement and industry, the need for more devices to help in visual communication and navigation through dangerous emergency situations with little or no visibility are of great importance to both preserving and saving lives. Personal recognition of an individual who has been injured or stranded in a fire would allow other emergency personnel to better assess the situation and provide the best treatment plan to the specific individual. Personal recognition would also be useful, not only if the emergency personnel was injured, but also for situational awareness. Because most emergency crews are required to wear helmets and facemasks, it is difficult to ascertain facial features of other emergency personnel. As such, there is a need for better methods and systems for improving the situational awareness of persons involved in an emergency situation during darkened, smoky, dusty or low-light conditions.

SUMMARY OF THE INVENTION

Thus, the present system provides a lightweight fire-resistant photoluminescent identifier system for firefighter's that is suitable for use on the firefighter's facemask as well as other equipment. The system is lightweight and provides individual recognition of an individual firefighter. The identifier system lights up automatically in a low-light environment without batteries, yet prevents glare to the firefighter using the system. The components that comprise the system are fire-resistant to temperatures up to and exceeding 500 degrees Fahrenheit. The system is constructed from a photoluminescent strip. The photoluminescent identifier system is constructed from various layers that provide properties not typically found in photoluminescent devices. The base layer includes a black or dark back face to prevent light from being directed into the facemask, and a pressure sensitive and heat resistant adhesive. The front surface of the base layer is constructed to be reflective silver. A photoluminescent layer is secured to the front face of the base layer with a heat sensitive adhesive, whereby heat is utilized to bond the photoluminescent layer to the base layer. A top layer is secured over the photoluminescent layer, also with a heat sensitive adhesive. The top layer is cut through in a desired pattern to create indicia when adhered over the photoluminescent layer. In this manner, the firefighter's name or other identifier is visible in both the light and in the dark, while the other desirable properties of the system are also provided.

Accordingly, it is an objective of the present invention to provide a fire-resistant photoluminescent identifier system for firefighters and other emergency personnel which, when worn by a user, allows for visual identification and personal recognition of the wearer in a hostile environment.

It is another objective of the present invention to provide a photoluminescent identifier system that is light in weight and constructed for attachment to emergency personnel equipment such as, but not limited to, a facemask, a helmet or a tank.

Yet another objective of the present invention is to provide a photoluminescent identifier system that lights up automatically in a dark or smoky environment without the need for batteries or other power supplies.

Still yet another objective of the present invention is to provide a photoluminescent identifier system that can be used on the clear facemask of an SCBA without the light being directed into the facemask.

It is still yet another objective of the present invention to provide a photoluminescent identifier system attachable to an SCBA of safety personnel that can withstand temperatures up to 500 degrees Fahrenheit.

A further objective of the present invention is to provide a photoluminescent identifier system that provides for personalized identifying indicia thereon to facilitate personal recognition of the wearer to the other emergency personnel in dark or low-light areas.

Still a further objective of the present invention is to provide a photoluminescent identifier system that is constructed in layers to provide versatility in construction and final configuration.

Still yet a further objective of the present invention is to provide a photoluminescent identifier system that is simple, reliable, requires no maintenance, and has a low cost.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DETAILED DESCRIPTION OF THE INVENTION

Figure 1:
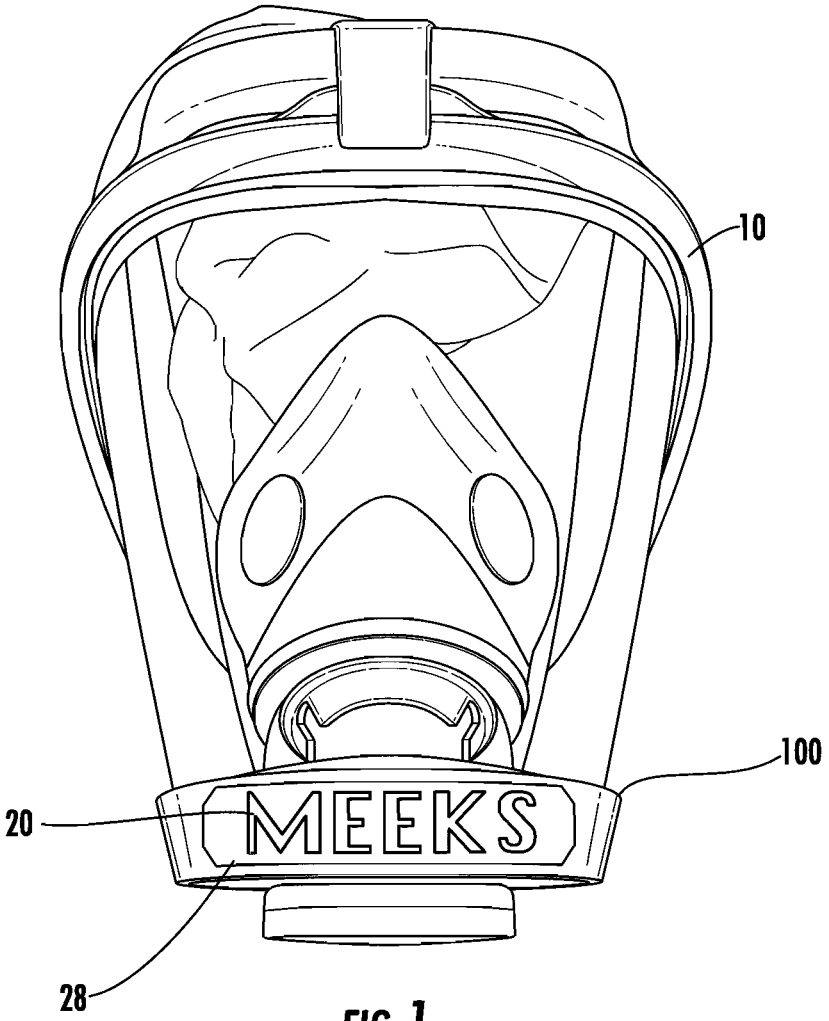
FIG. 1 is a front view of one embodiment of the photoluminescent identifier system secured to the frame of a facemask.
Figure 2:
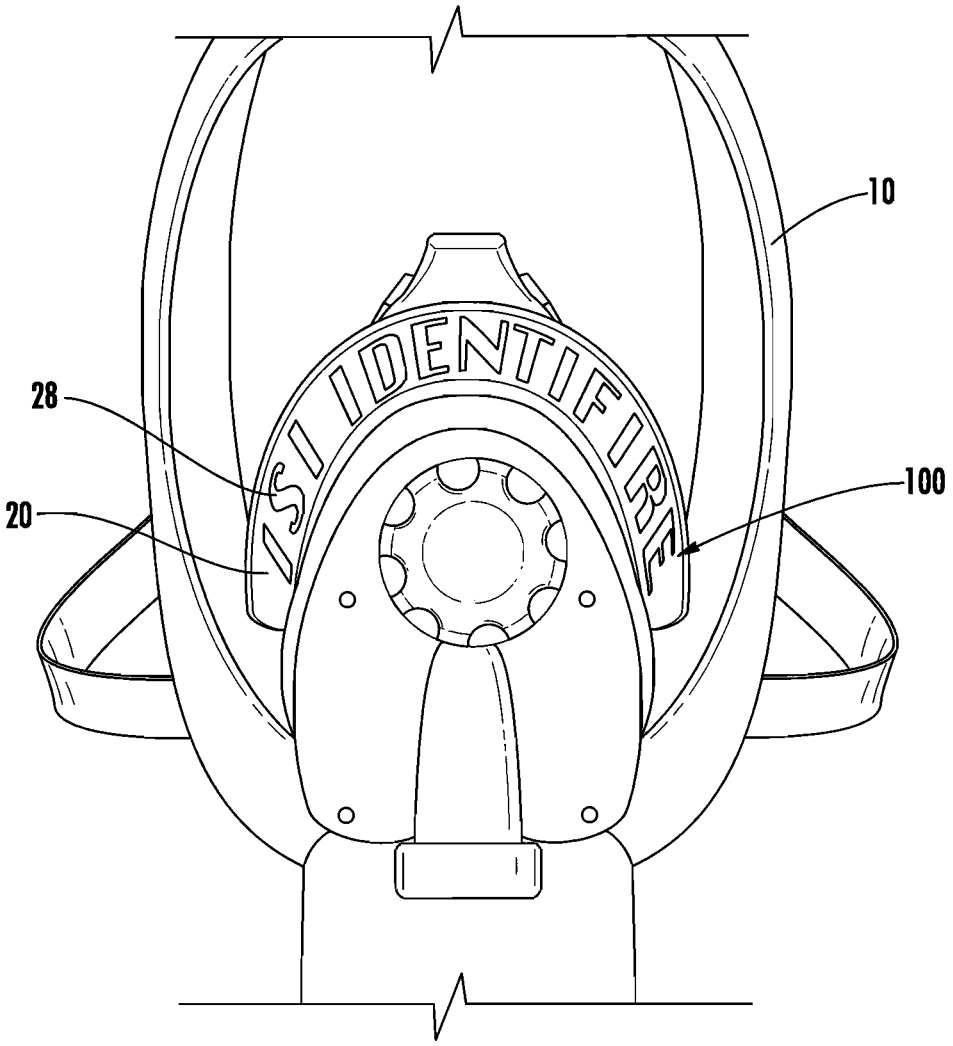
FIG. 2 is a front view of one embodiment of the photoluminescent identifier system secured to the clear portion, or lens, of a facemask, represented in a low-light environment.
Figure 3:
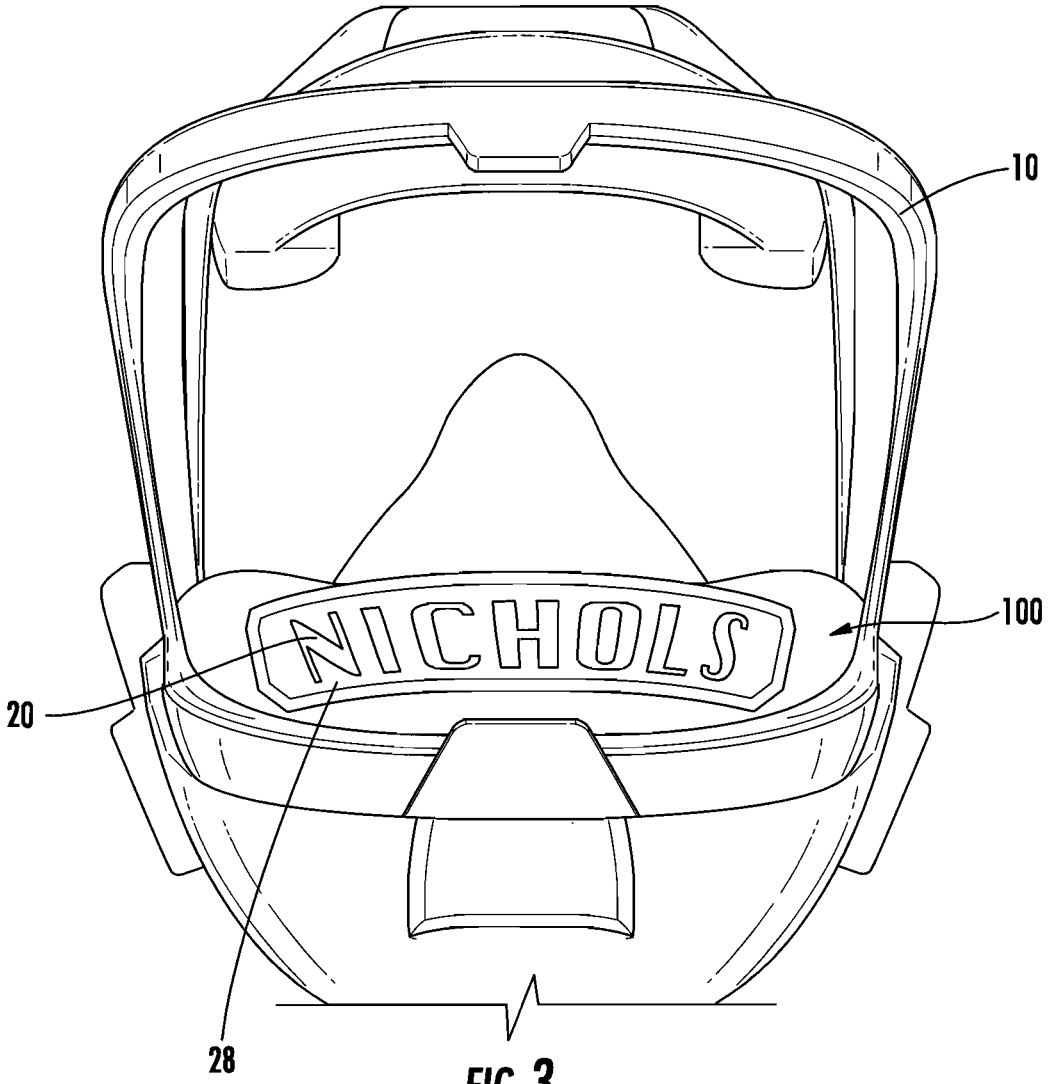
FIG. 3 is a front view of one embodiment of the photoluminescent identifier system secured to the clear portion, or lens, of a facemask, represented in a full-light environment.
Figure 4:
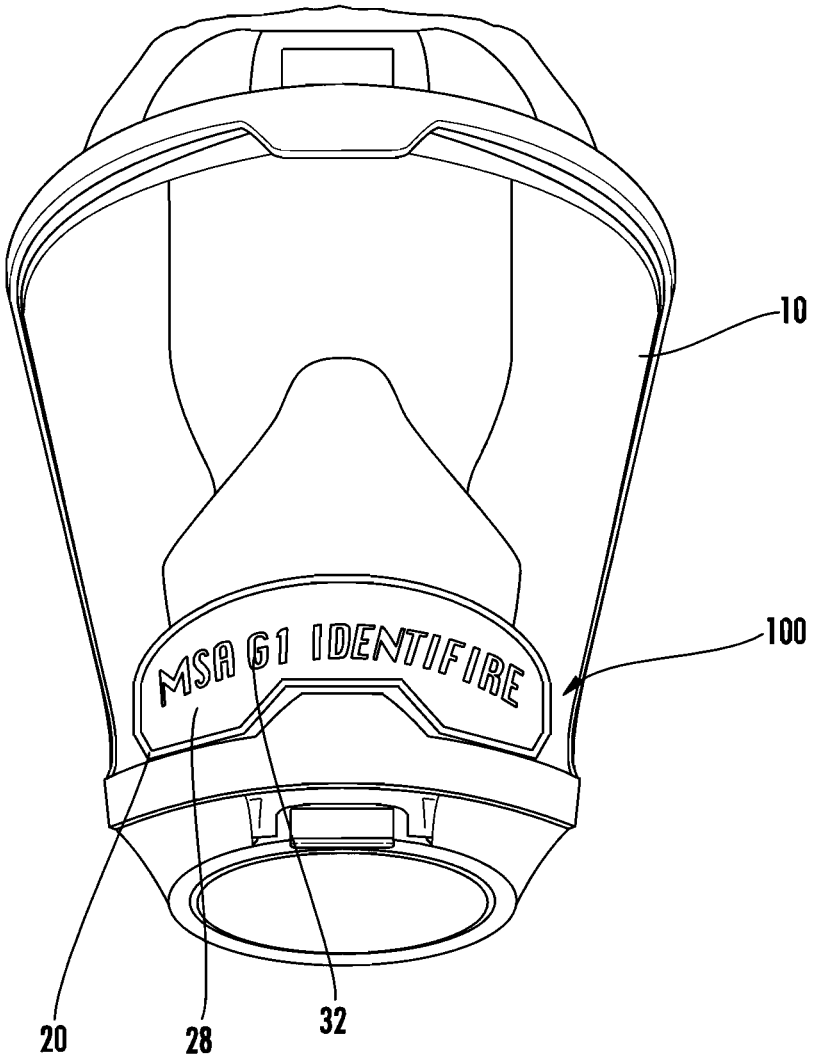
FIG. 4 is a front view of one embodiment of the photoluminescent identifier system secured to the clear portion, or lens, of a facemask, represented in a full-light environment.
Figure 5:
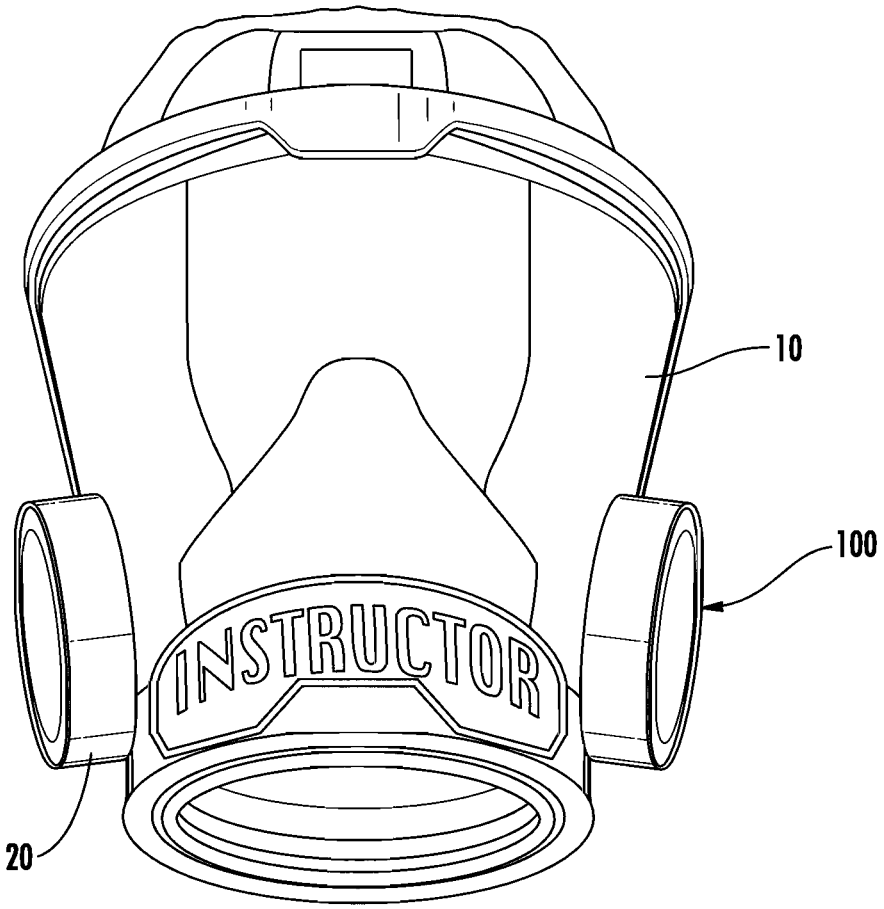
FIG. 5 is a front view of one embodiment of the photoluminescent identifier system secured to the clear portion, or lens, of a facemask represented in a full-light environment.
Figure 6:
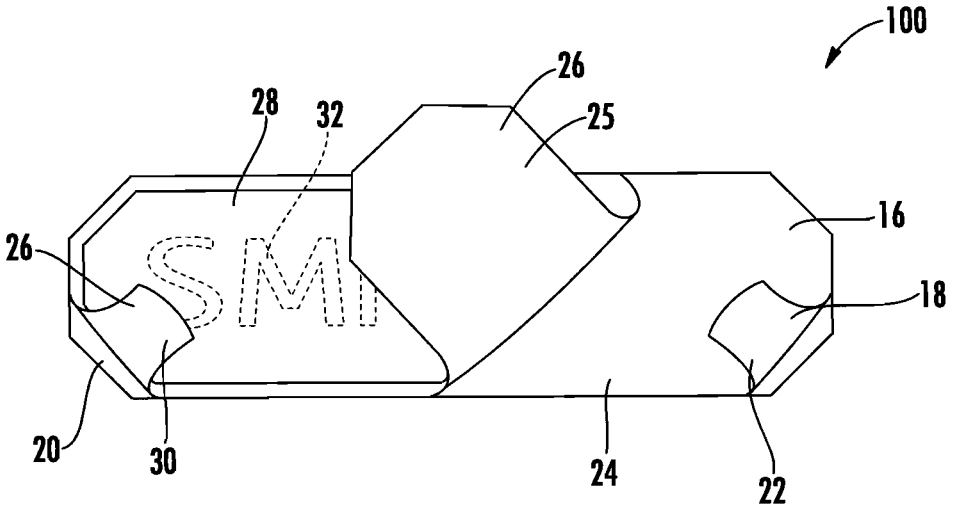
FIG. 6 is a front view illustrating the layered construction of the photoluminescent identifier system.
Figure 7:
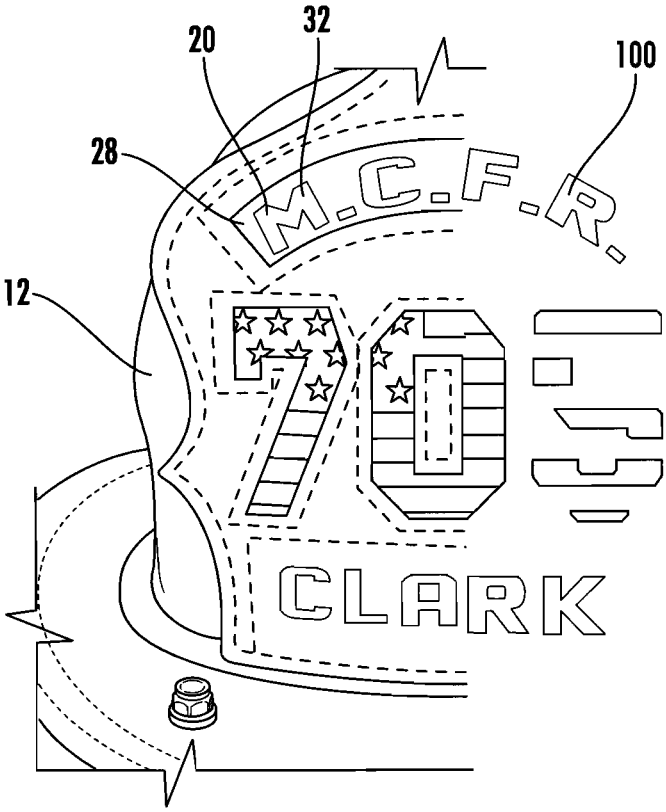
FIG. 7 is a front view illustrating the photoluminescent identifier system secured to a firefighter's helmet, shown half in full light and half in low light.
Figure 8:
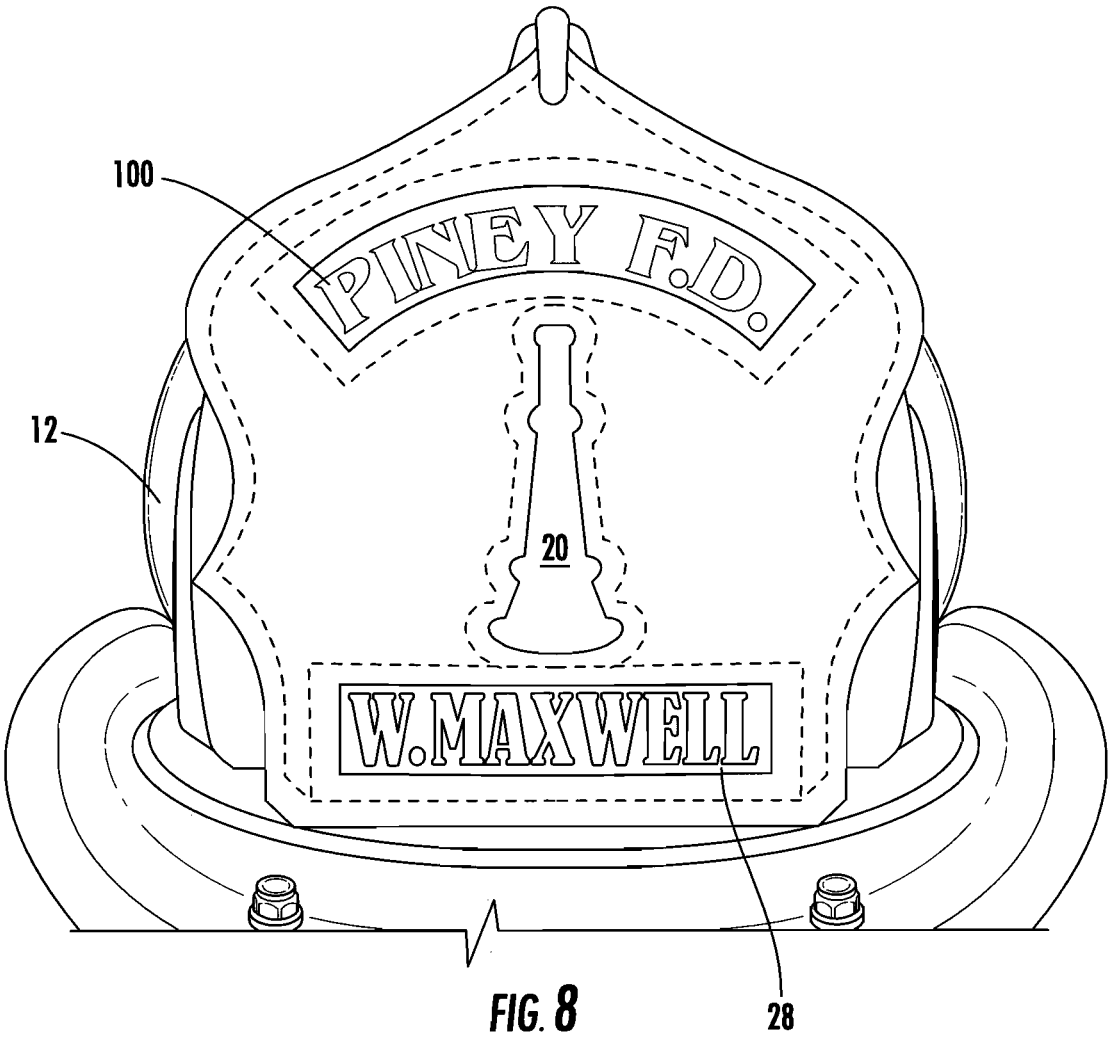
FIG. 8 is a front view illustrating the photoluminescent identifier system secured to a firefighter's helmet, shown secured under leather with cutouts.
Figure 9:
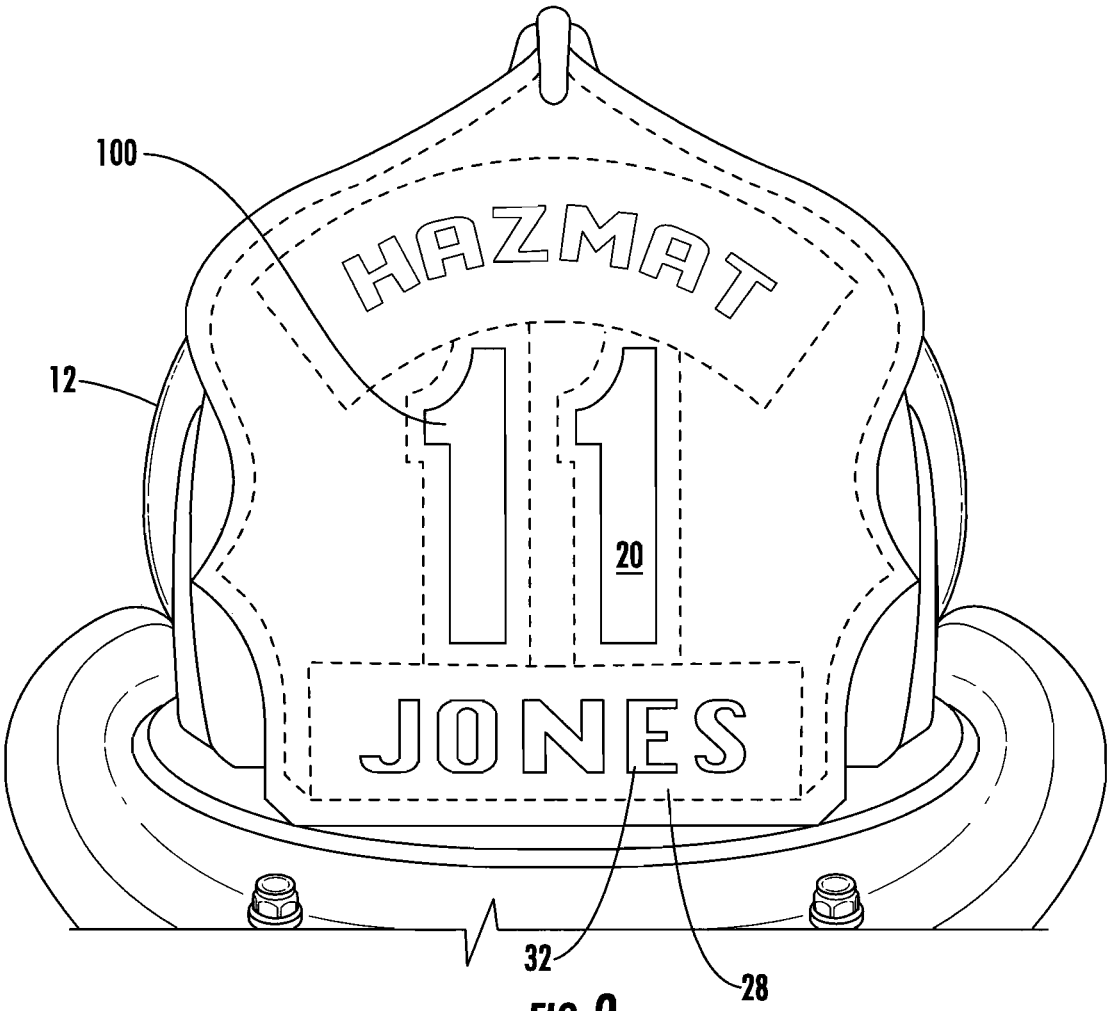
FIG. 9 is a front view illustrating the photoluminescent identifier system secured to a firefighter's helmet, shown secured under leather with cutouts.
Figure 10:
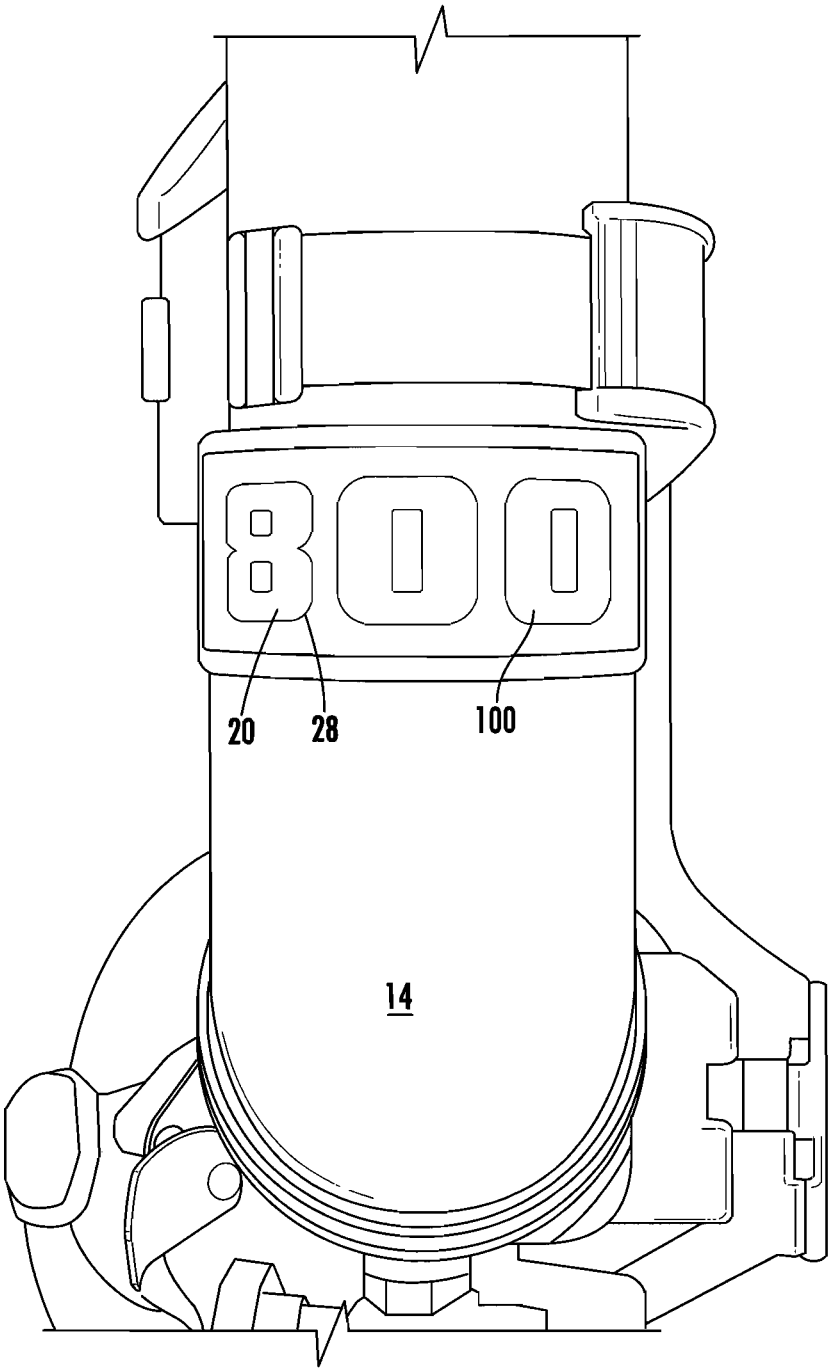
FIG. 10 is a front view illustrating the photoluminescent identifier system secured to a firefighter's tank, shown secured to a leather strap.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring now to FIGS. 1-10, a lightweight fire-resistant photoluminescent identifier system 100 for firefighters is illustrated. The photoluminescent identifier system 100 is suitable for use on the firefighter's facemask 10, helmet 12, or tank 14, as well as other equipment. The photoluminescent identifier system 100 is lightweight and provides individual recognition of an individual firefighter. The photoluminescent identifier system 100 is constructed and arranged to light up automatically in a low-light environment through photoluminescent technology without batteries; yet, the photoluminescent identifier system 100 is constructed to prevent glare or eye adjustment to low light to the firefighter using the system. The components that construct the photoluminescent identifier system 100 are fire-resistant to temperatures up to and exceeding 500 degrees Fahrenheit. In a preferred embodiment, the photoluminescent layer 20 is constructed by 3M. The photoluminescent identifier system 100 is constructed from various layers that provide properties not typically found in photoluminescent devices. The base layer 16 includes a black or dark back face 18 to prevent light from being directed into the facemask from the photoluminescent layer 20. The back face 18 of the base layer 16 also includes a pressure sensitive and heat resistant adhesive layer 22 for attaching the base layer to the facemask 10 or other piece of equipment. The front surface 24 of the base layer 16 is constructed to be reflective silver. In this manner, photons from the photoluminescent layer 20 are reflected back out the front of the photoluminescent system 100 to create a brighter indicator. The photoluminescent layer 20 is secured to the front surface 24 of the base layer 16 with a heat sensitive adhesive 26 positioned on the back surface 25 of the photoluminescent layer 20, whereby heat is utilized to bond the photoluminescent layer 20 to the base layer 16 to prevent separation in extreme heat, and allow the layered photoluminescent identifier system 100 to be utilized as a single assembly for attachment and use. A top layer 28 is secured over the photoluminescent layer 20, also with a heat sensitive adhesive 26 positioned on the rear face 30 of the top layer 28. The top layer 28 is cut through in a desired pattern to create indicia 32 when adhered over the photoluminescent layer 20, which allows the photoluminescent layer 20 to be viewed in the sandwiched construction. In a most desirable embodiment, the color of the top layer 28 is chosen to provide a color contrast with respect to the photoluminescent layer 20. In this manner, the firefighter's name or other identifier is visible in both the light and in the dark, while the other desirable properties of the system are also provided. The photoluminescent identifier system 100 may be assembled with the base layer 16, photoluminescent layer 20 and top layer 28 in place prior to shipment, whereby the user merely needs to peel away a backing layer (not shown) for attachment with the pressure sensitive and heat resistant adhesive 22 in a desired position on the firefighter's equipment.

Figure 11:
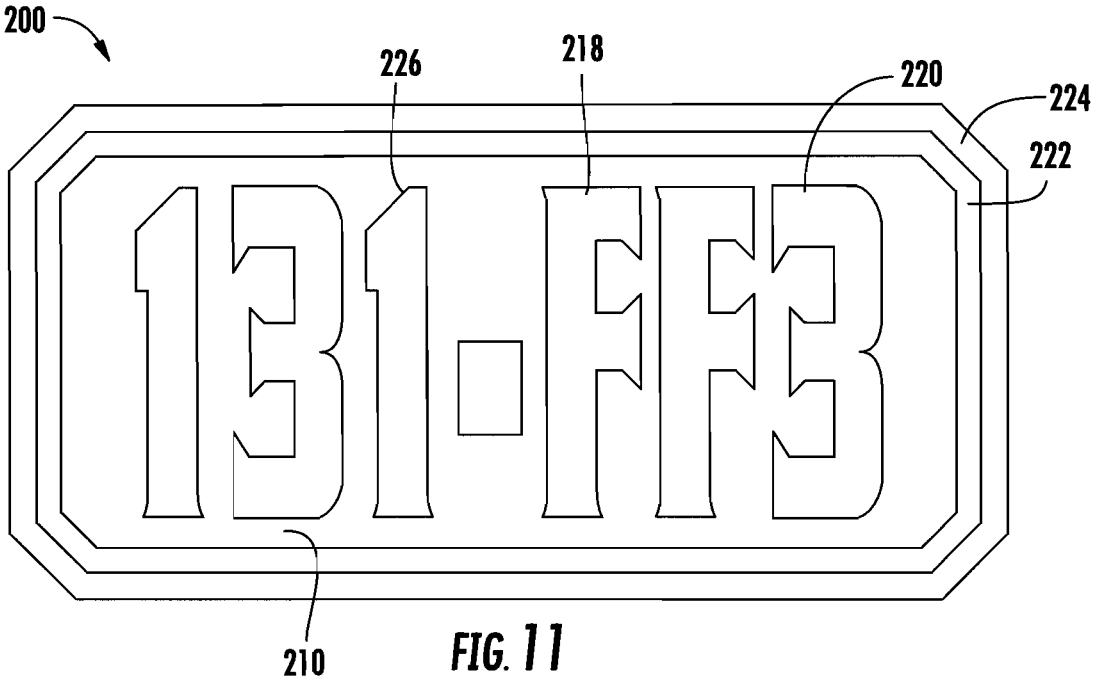
FIG. 11 is a front view of an alternative embodiment of the photoluminescent identifier.
Figure 12:
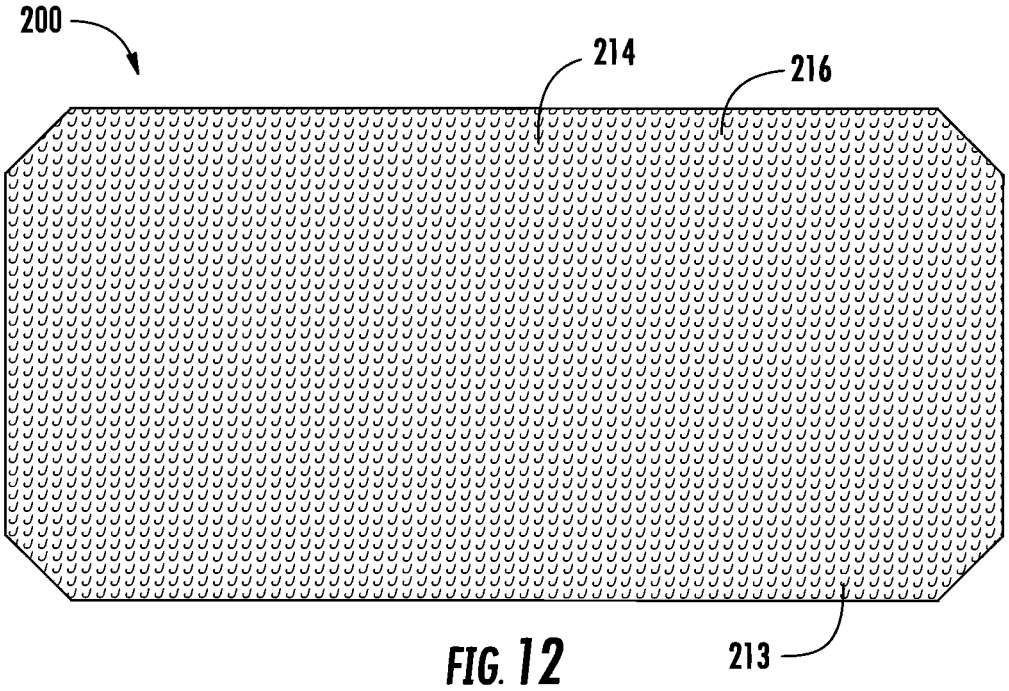
FIG. 12 is back side view of the photoluminescent identifier shown in FIG. 11.
Figure 13:
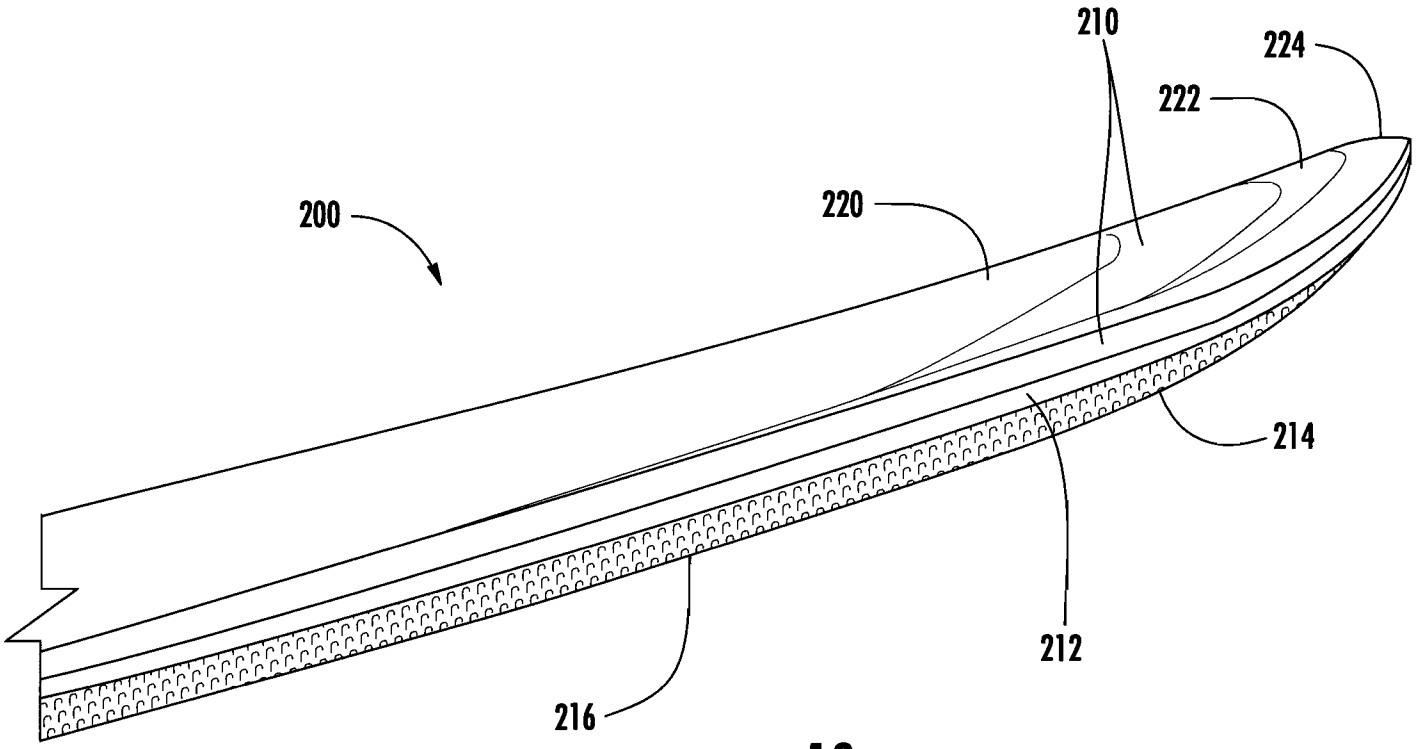
FIG. 13 is a perspective view of the photoluminescent identifier shown in FIG. 11, illustrating the layered construction of the photoluminescent identifier system.

Referring now to FIGS. 11-13, an alternative embodiment of the lightweight fire-resistant photoluminescent identifier system 200 for firefighters is illustrated. The photoluminescent identifier system 200 is suitable for use on the firefighter's equipment, such as helmet, a facemask, or an oxygen tank 14. In the same manner as described for the photoluminescent identifier system 100, the photoluminescent identifier system 200 is preferably lightweight and provides individual recognition of an individual firefighter. The photoluminescent identifier system 200 is constructed and arranged to light up automatically in a low-light environment through photoluminescent technology without batteries; yet, the photoluminescent identifier system 200 is constructed to prevent glare or eye adjustment to low light to the firefighter using the system. The components that construct the photoluminescent identifier system 200 are fire-resistant to temperatures up to and exceeding 500 degrees Fahrenheit.

The photoluminescent identifier system 200 is constructed from various layers that provide properties not typically found in photoluminescent devices. In a preferred embodiment, the photoluminescent identifier system 200 may contain multiple layers of materials, including a top photoluminescent layer 210, a middle layer 212, and a securing layer 214. The photoluminescent layer 210 is preferably made of a rigid material or a semi-rigid material that is flexible but maintains its shape unless a force, such as a bending force, is applied. The photoluminescent layer 210 may be made, for example, of a rubberized poly vinyl chloride (PVC) based material, with pigments that glow, such as photoluminescent pigments manufactured by Jinan Realglow Luminous Technology Co., Ltd., Jinan City, China or Glow Nest, Mumbai, India, or Peramalight, USA. The photoluminescent layer 210 may made with other materials, such as polyurethane, polypropylene, polyethylene, ethylene vinyl acetate. Accordingly, the photoluminescent layer 210 may be made of a rigid or semi-rigid PVC material with Realglow photoluminescent pigments. The rubberized PVC is preferably fire or heat resistant and/or self-extinguishable. The middle layer 212 is preferably a white backing (such as a heat transfer vinyl with a 500-GOO microns thickness, such as DIMENSION from Specialty Materials) which provides for photoluminescent or pigment intensification. That is, the photoluminescent layer glow is intensified by inclusion of the middle layer 212. The middle layer 212 may also be constructed of a material that prevents visualization of the layers below it. The middle layer 212 may include a pressure sensitive or heat resistant adhesive for attaching to the photoluminescent layer 210. The photoluminescent layer 210 may be configured to glow various colors, such as a green-yellow color glowing photoluminescent pigment based on Strontium Aluminate, blue-green glowing photoluminescent pigment based on Strontium Aluminate, a blue color pigment based on Strontium Silicate, or other colors such as purple, white, or orange-red. As an illustrative example, the green-yellow color glowing photoluminescent pigment may have chemical structure of $Sr_4Al_2O_4$:Eu,Dy. As an illustrative example, the blue-green color glowing photoluminescent pigment may have chemical structure of $Sr_4Al_{14}O_{25}$:Eu,Dy. As an illustrative example, the blue color glowing photoluminescent pigment may have chemical structure of $CaAl_2O_4$:Eu,Nd. As an illustrative example, the purple glowing photoluminescent pigment may have chemical structure of $CaAl_2O_4$:Eu,Nd. As an illustrative example, the white color glowing photoluminescent pigment may have chemical structure of $CaAl_2O_4$:Eu,Nd. As an illustrative example, the orange-red color glowing photoluminescent pigment may have chemical structure of $Y_2O_5S$:Eu,Ln.

The securing layer 214 is configured to provide a mechanism for the photoluminescent identifier system 200 to be secured to an item, such as a firefighter's equipment, including a helmet, a facemask, or an oxygen tank. As shown in FIG. 12 or FIG. 13, securing layer 214 is illustrated as a first portion of a fastening system, illustrated herein as the hook portion 216 of VELCRO, or loop and hook fastening system. Preferably, the hook portion 216 of VELCRO is heat bonded to the middle reflective layer 212, or to the top photoluminescent layer 210 if no middle reflective layer 212 is added, and includes a black colored surface 213. Alternatively, the securing layer 214 may be a pressure sensitive and heat resistant adhesive, whereby the user merely needs to peel away a backing layer (not shown) for attachment with the pressure sensitive and heat resistant adhesive in a desired position on the firefighter's equipment.

One or more of the top photoluminescent layer 210, the middle layer 212, or the securing layer 214 may utilize heat to bond one or more of the layers together in order to prevent separation in extreme heat and allow the layered photoluminescent identifier system 200 to be utilized as a single assembly for attachment and use. The photoluminescent layer 210 may include an indicia layer 218, also secured using a heat sensitive adhesive, which is cut through in a desired pattern to create indicia 220, such as letters, numbers, symbols, or combinations thereof. In a most desirable embodiment, the color of the indicia layer 218 is chosen to provide a color contrast with respect to the photoluminescent layer 210. The indicia 220, or any other part of the photoluminescent identifier system 200, may be configured to be infrared reflective. In this manner, the firefighter's name or other identifier is visible in both the light and in the dark, while the other desirable properties of the system are also provided. The indicia layer 218 may be made of a reflective tape or fire retardant reflective fabric, or heat pressed reflective vinyl. The reflective material may not be in the form of letters or numbers but may be in the form of a weave or other pattern. In any form, the photoluminescent identifier system 200 preferably includes a reflective layer or competent.

The photoluminescent layer 210 may also include a black or dark border 222, inside of a secondary colored border portion 224, to prevent light from being directed into the facemask from the photoluminescent layer 210. The black or dark border 222 and the secondary colored border portion 224 also include a pressure sensitive and heat resistant adhesive for attaching the base layer to the photoluminescent layer 210. Indicia 220 may be outlined in a dark or black outline 226 in order to provide contrast. Preferably, only a black or dark border 222 is used.

In an illustrative example, the photoluminescent layer 210 may be made by mixing photo photoluminescent materials such as dyes or pigments with a liquid rubberized PVC based material, at for example, 40% load of photoluminescent pigments. The other layers, such as the securing layer 214 VELCRO and the middle layer 212 white backing materials may be molded together with the photoluminescent layer 210, via heat. The reflective layer, such as the reflective lettering, may then be added to the above.

Figure 14:
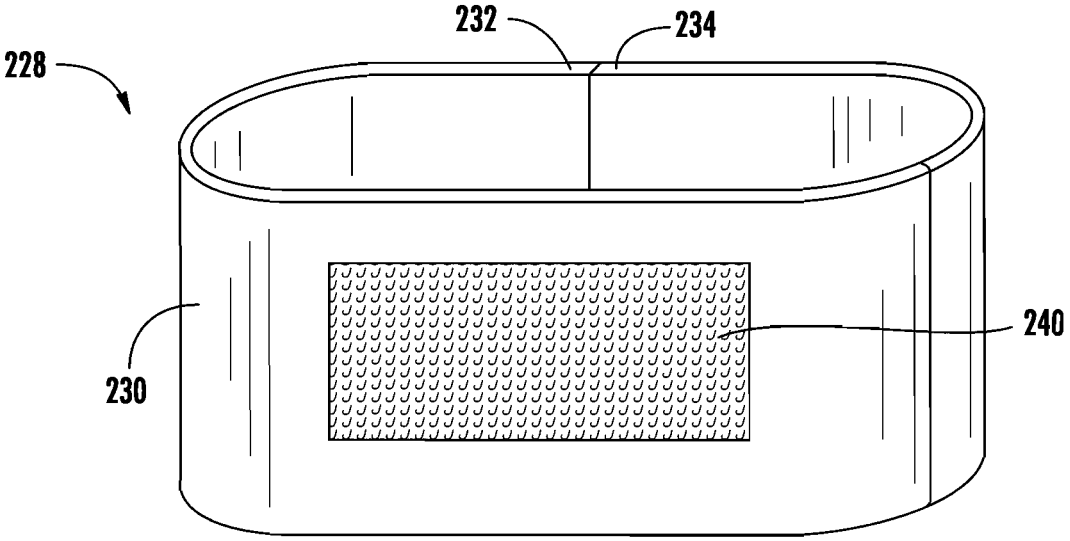
FIG. 14 is a perspective view of a photoluminescent identifier receiving band.
Figure 15:
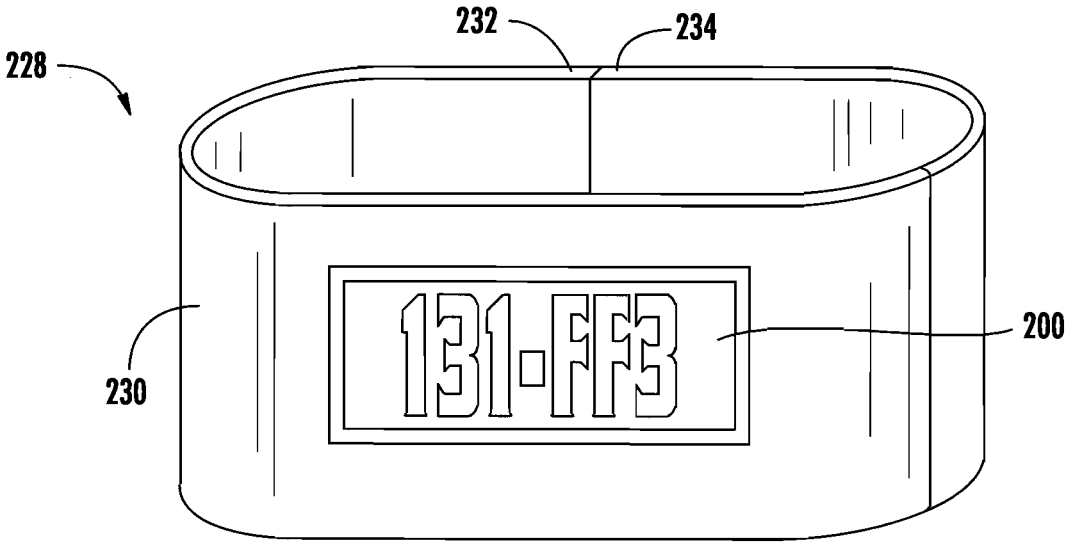
FIG. 15 is a perspective view of the photoluminescent identifier receiving band, shown with the photoluminescent identifier illustrated in FIG. 11.
Figure 16:
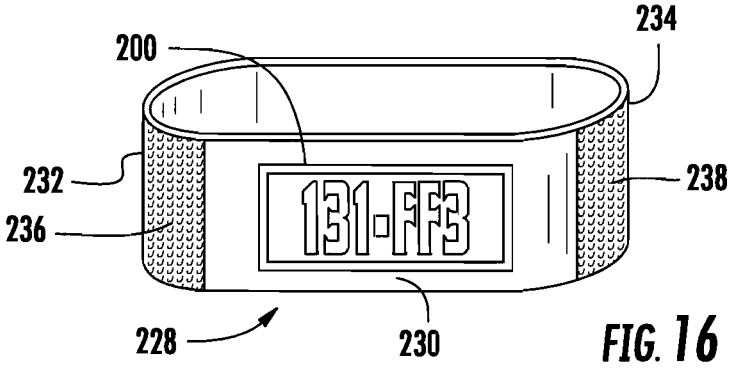
FIG. 16 illustrates the photoluminescent identifier receiving band in an outstretched orientation.

FIGS. 14-16 illustrate a photoluminescent identifier receiving band 228 which is configured to secure the photoluminescent identifier system 200 thereto and secure to the firefighter's equipment. The photoluminescent identifier receiving band 228 may be made of a single body 230 that has a first end 232 and a second, opposing end 234. The first end 232 and the second, opposing end 234 are configured to secure together to form a unitary body that can be wrapped around and secured to the firefighter's equipment. For instance, the first end 232 may have the loop proportion 236 of VELCRO and the second end 234 may have the hook portion 238 of VELCRO. Alternative fastening mechanisms, such as snaps, a zipper, or buttons, may be used as well to secure the ends together. Alternatively, the photoluminescent identifier receiving band 228 may be a single band made of a flexible material so as to extend over at least a portion of a firefighter's equipment, and then return to its non-stretched shape. To secure the photoluminescent identifier system 200 thereto, the photoluminescent identifier receiving band. 228 includes a second portion of a fastening system, illustrated herein as the loop Portion 240 of VELCRO. Securing the securing layer 214 of the photoluminescent identifier system. 200 to the loop portion 240 of VELCRO allows the photoluminescent identifier receiving band 228 with photoluminescent identifier system 200 to be secured to a strap 242, see FIG. 18, or to a tank 244, see FIG. 19. The photoluminescent identifier receiving band 228 may be made of Armor AP (80% Meta/Para Aramid spun yarns (65% Meta Aramid, 35% Para-Aramid) and 20% 400 denier DuPont KEVLAR filament). Alternatively, photoluminescent identifier receiving band 228 may be made of NOMEX (meta aramid).

Figure 17:
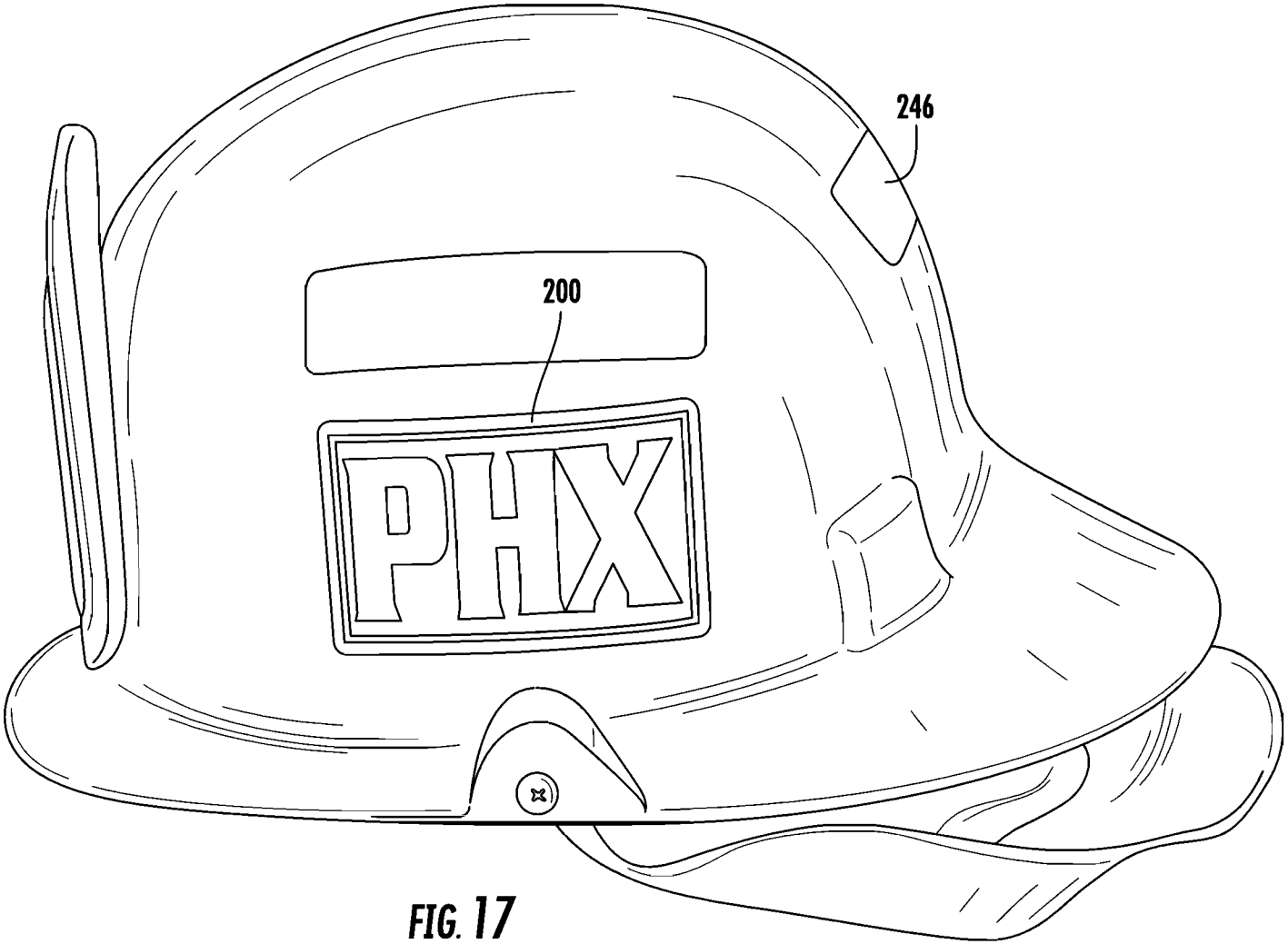
FIG. 17 is a side view illustrating the photoluminescent identifier system illustrated in FIG. 11 secured to a firefighter's helmet.
Figure 18:
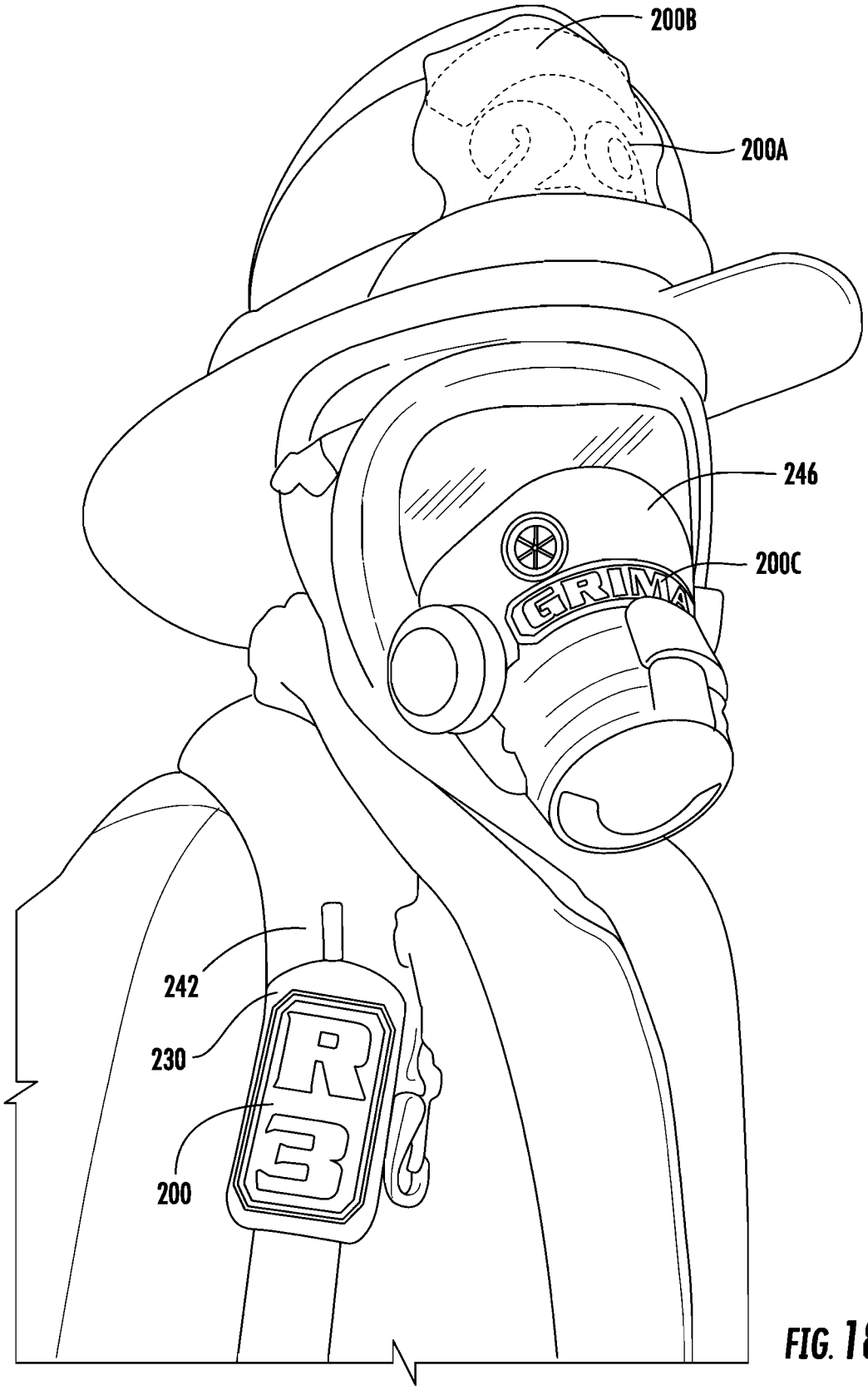
FIG. 18 illustrates the photoluminescent identifier system illustrated in FIG. 11 secured to a firefighter's tank, shown secured to a leather strap via the photoluminescent identifier receiving band, and to other portions a firefighter's helmet and mask.
Figure 19:
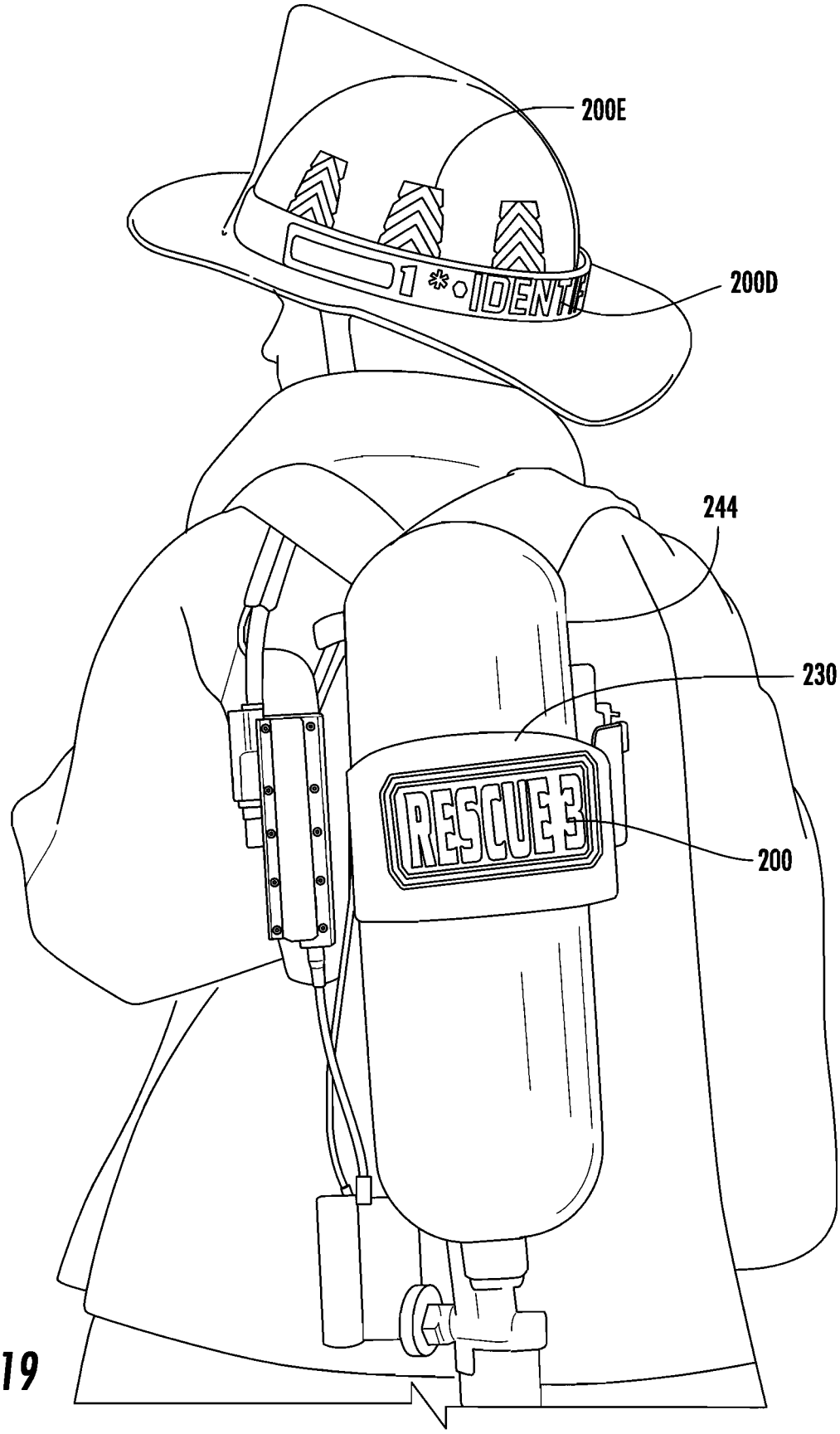
FIG. 19 illustrates the photoluminescent identifier system illustrated in FIG. 11 secured to a firefighter's tank via the photoluminescent identifier receiving band, and to other portions of a firefighter's helmet and mask.

FIGS. 17, 18 and 19 also illustrate the photoluminescent identifier system 200 being applied to helmet 246. The figures also illustrate that the photoluminescent identifier system 200 may have various indicia, including the number "29", 200A, a shield, 200B, the name or word "GRIMA", 200C, on mask 246, "IDENNTIF" 200D, an arrow head like pattern 200E.

Figure 20:
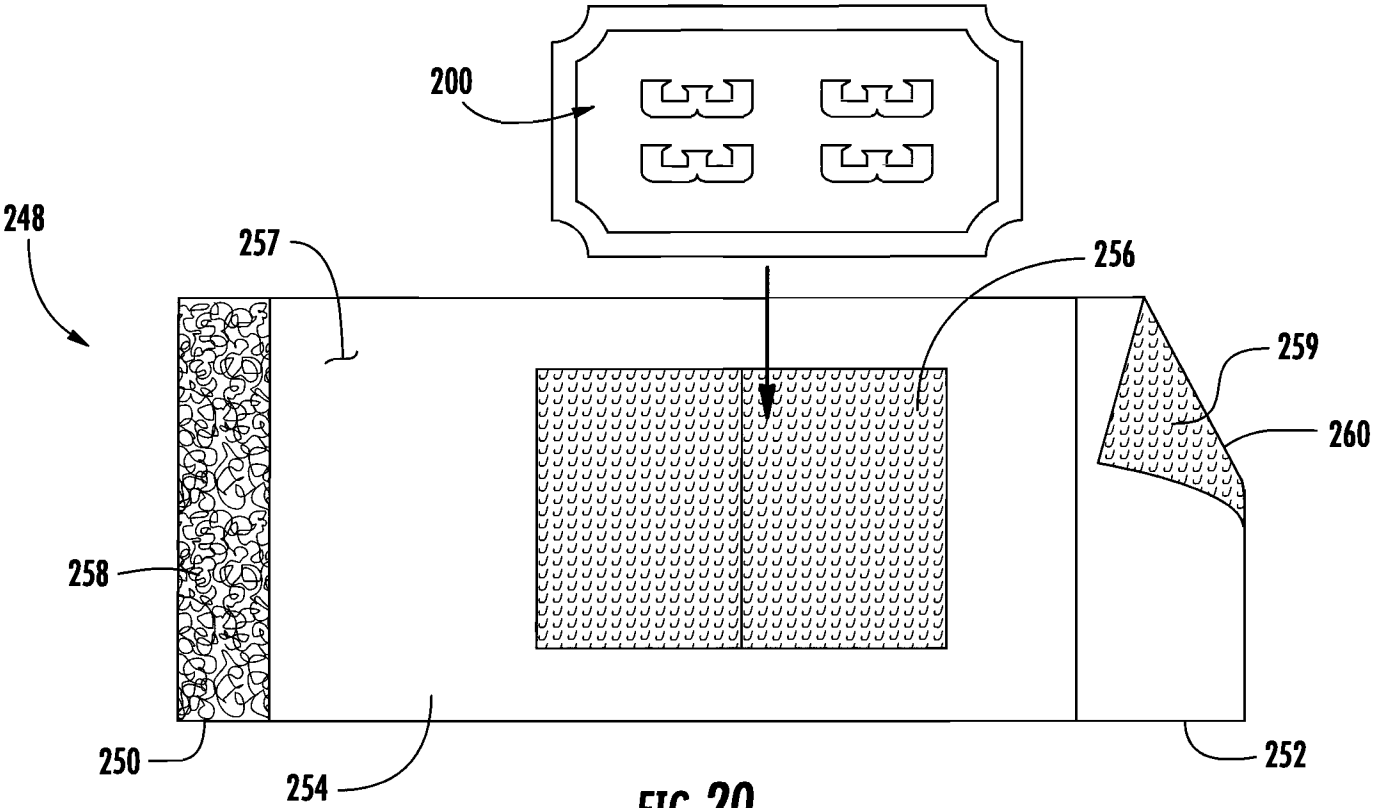
FIG. 20 is an illustrative embodiment of a trifold photoluminescent identifier receiving band.
Figure 21:
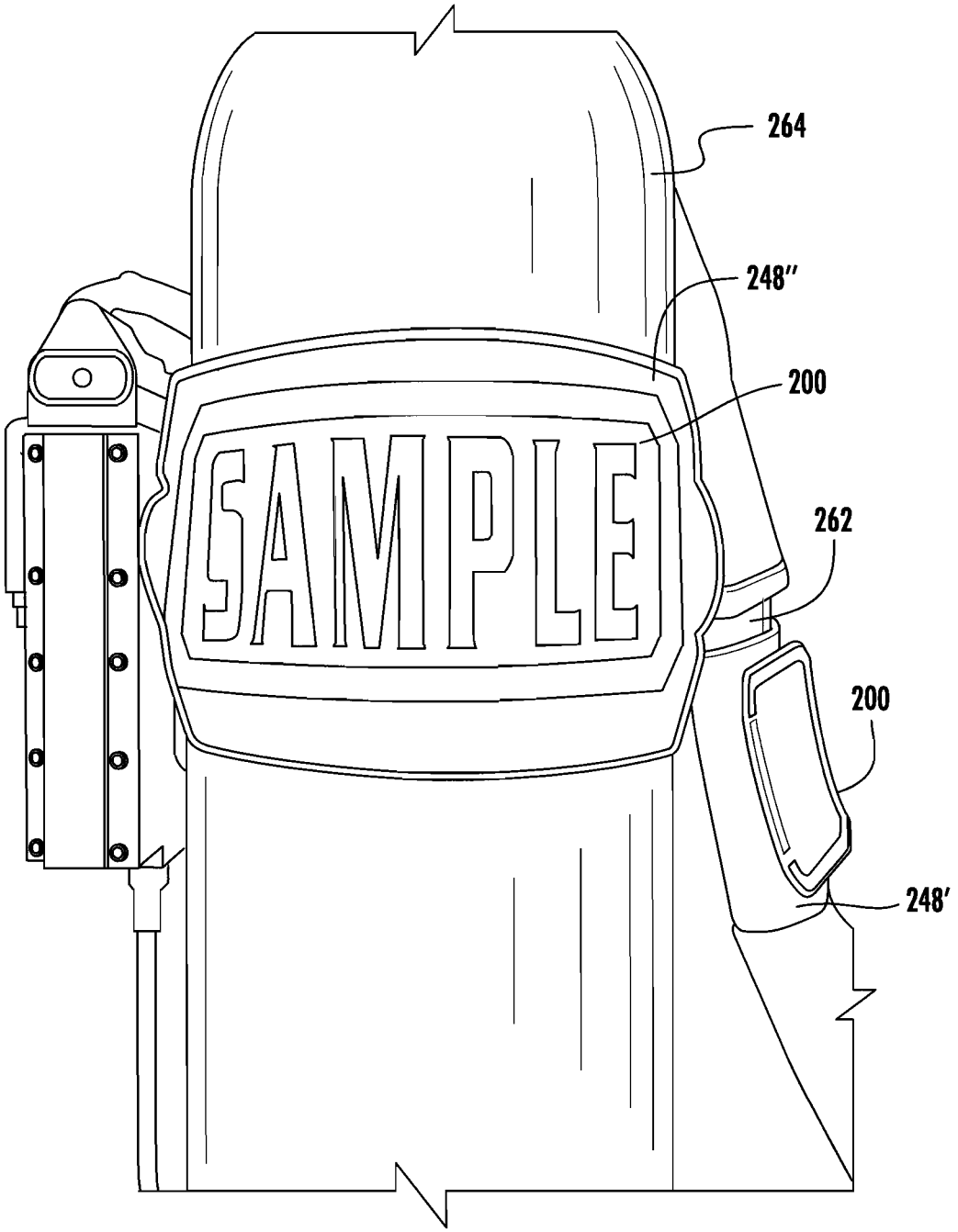
FIG. 21 illustrates the secreting of the securing of the trifold photoluminescent identifier receiving band to a strap or an oxygen tank.

Referring to FIG. 20, an illustrative example of a trifold photoluminescent identifier receiving band 248 which is configured to secure the photoluminescent identifier system 200 thereto and secure to the firefighter's equipment is shown. The trifold photoluminescent identifier receiving band 248 may be made of Armor AP (80% Meta/Para Aramid spun yarns (65% Meta Aramid, 35% Para-Aramid) and 20% 400 denier DuPont KEVLAR filament. Alternatively, the trifold photoluminescent identifier receiving band 248 may be made of NOMEX (meta aramid) The trifold photoluminescent identifier receiving band 248 may comprise a first end 250, a second end 252, and main body 254 therebetween. The main body may have a hook or loop portion 256 of VELCRO, or loop and hook fastening, which secures the photoluminescent identifier system. 200 thereto. The first end 250 may include the loop portion 258 of VELCRO (top surface 257) and the second end may include the hook portion 260 of VELCRO (bottom surface 259) arranged to allow for securing onto itself. FIG. 21 illustrates a version of the photoluminescent identifier system 200 attached to two versions of trifold photoluminescent identifier receiving band 248 (indicated as 248' and 248") secured to a strap 262 or oxygen tank 264.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that, while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A photoluminescent identifier system for firefighting or personal protective equipment comprising:

a photoluminescent identifier tag for use with firefighting or personal protective equipment; and a photoluminescent identifier tag receiving band having a body configured to receive and secure said photoluminescent identifier tag thereto and configured to secure to said firefighting or personal protective equipment;

said photoluminescent identifier tag comprising:

an upper photoluminescent layer comprising a fire or heat resistant or self-extinguishable rigid or semi-rigid rubberized PVC material intermixed with photoluminescent pigment (s) or dye(s), thus forming a single layer that is flexible but maintains its shape unless a force is applied, said photoluminescent layer glows in the dark after being exposed to light;

a bottom layer and having a first portion of a fastening system sized and shaped to secure to a portion of said photoluminescent identifier tag receiving band;

a middle layer made of a material that prevents visualization of said bottom layer, said middle layer positioned between said upper photoluminescent layer and said bottom layer wherein said middle layer, said upper photoluminescent layer, and said bottom layer are bonded together to prevent separation in extreme heat and allow said photoluminescent identifier system tag to be utilized as a single assembly for attachment and use; and an indicia layer bonded to said photoluminescent layer and having a material that has a color contrast with respect to said photoluminescent layer, said indicia including at least one component that provides identification information of an individual wearing or using said photoluminescent identifier system;

wherein said identifier system provides identification information when used with firefighting or personal protective equipment.

2. The photoluminescent identifier system according to claim 1, wherein said indicia layer includes one or more letters, one or more numbers, one or more symbols, one or more patterns, or combinations thereof.

3. The photoluminescent identifier system according to claim 1, wherein said first portion of a fastening system of said bottom layer includes a first portion of a hook and loop fastening system.

4. The photoluminescent identifier system according to claim 3, wherein said bottom layer includes a black background.

5. The photoluminescent identifier system according to claim 1, wherein said photoluminescent identifier system tag is constructed and arranged to light up automatically in a low-light environment through said photoluminescent pigment or dye.

6. The photoluminescent identifier system according to claim 1, wherein said photoluminescent layer may also include a dark colored or black border.

7. The photoluminescent identifier system according to claim 6, wherein said photoluminescent layer includes a second colored border.

8. The photoluminescent identifier system according to claim 2, wherein said indicia is outlined in a dark color or black outline.

9. The photoluminescent identifier system according to claim 1, wherein said photoluminescent identifier tag receiving band comprises a second portion of a hook and loop fastening system sized and shaped to secure to said photoluminescent identifier tag bottom layer.

10. The photoluminescent identifier system according to claim 1, wherein said components of said photoluminescent identifier system are fire-resistant to temperatures up to 500 degrees Fahrenheit.

11. The photoluminescent identifier system according to claim 1, wherein said photoluminescent identifier system is secured to a firefighter's helmet.

12. The photoluminescent identifier system according to claim 1, wherein said photoluminescent identifier system is secured to a firefighter's air tank.

13. The photoluminescent identifier system according to claim 1, wherein said photoluminescent identifier system is secured to one or more firefighting or personal protective equipment straps.

14. The photoluminescent identifier system according to claim 1, wherein at least a portion of said photoluminescent identifier system is infrared reflective.

15. The photoluminescent identifier system according to claim 2, wherein at least a portion of said indicia is infrared reflective.

16. The photoluminescent identifier system according to claim 1, wherein said middle layer is made from a heat transfer vinyl with at least 500-600 microns thickness.

17. The photoluminescent identifier system according to claim 9, wherein said photoluminescent identifier receiving band is made of an aramid polymer.

18. The photoluminescent identifier system according to claim 1, wherein said indica is made of a reflective material or a fire retardant reflective material.

* * * * *